US009035561B2

(12) United States Patent
Tsai et al.

(10) Patent No.: US 9,035,561 B2
(45) Date of Patent: May 19, 2015

(54) LED DRIVING SYSTEM AND METHOD

(71) Applicant: Ampower Technology Co., Ltd., Jhongli, Taoyuan County (TW)

(72) Inventors: Cheng-Hung Tsai, Taoyuan (TW); Yong-Long Lee, Taoyuan (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 225 days.

(21) Appl. No.: 13/860,568

(22) Filed: Apr. 11, 2013

(65) Prior Publication Data

US 2013/0271019 A1 Oct. 17, 2013

(30) Foreign Application Priority Data

Apr. 13, 2012 (TW) ..... 101113186 A

(51) Int. Cl.
*H05B 41/00* (2006.01)
*H05B 33/08* (2006.01)

(52) U.S. Cl.
CPC ..... *H05B 33/0815* (2013.01); *H05B 33/0827* (2013.01)

(58) Field of Classification Search
None
See application file for complete search history.

(56) References Cited

U.S. PATENT DOCUMENTS

2010/0164403 A1* 7/2010 Liu ..... 315/297
2013/0249420 A1* 9/2013 Lee et al. ..... 315/192

* cited by examiner

*Primary Examiner* — Long Nguyen
(74) *Attorney, Agent, or Firm* — Novak Druce Connolly Bove + Quigg LLP

(57) ABSTRACT

An exemplary light emitting diode (LED) driving system includes a direct current/direct current (DC/DC) converter, a detection circuit, a control circuit, a pulse width modulation (PWM) controller, and a current balance circuit. The DC/DC converter outputs a suitable direct current voltage to drive an LED array. The detection circuit detects cathode voltages of LED strings of the LED array. The control circuit generates and outputs a control signal to the PWM controller, and generates and outputs various adjusting signals. The current balance circuit adjusts current flowing through two of the LED strings, which have a minimum and a maximum detected cathode voltage, respectively. The current balance circuit includes switches. A related LED driving method is also provided.

11 Claims, 4 Drawing Sheets

LED DRIVING SYSTEM AND METHOD

BACKGROUND

1. Technical Field

The disclosure relates to backlight driving systems, and particularly to a light emitting diode (LED) driving system and an LED driving method of a display device.

2. Description of Related Art

Light emitting diodes (LEDs) are increasingly utilized as display backlights. As a good display requires smooth LED backlighting, switches are connected to LED strings in series, to balance current flowing through each LED string. Usually, drivers of the LED strings provide sufficient voltage that satisfies voltage drop requirements of the LED strings to enable a sufficiency of current to the LED strings. However, because individual LEDs may have slightly different performance characteristics, different LED strings may show different voltage drops. A switch connected to one of the LED strings with a minimum voltage drop may overfeed the LED string, which may cause great power loss (wastage) and induce thermal stress.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

Figure 1:
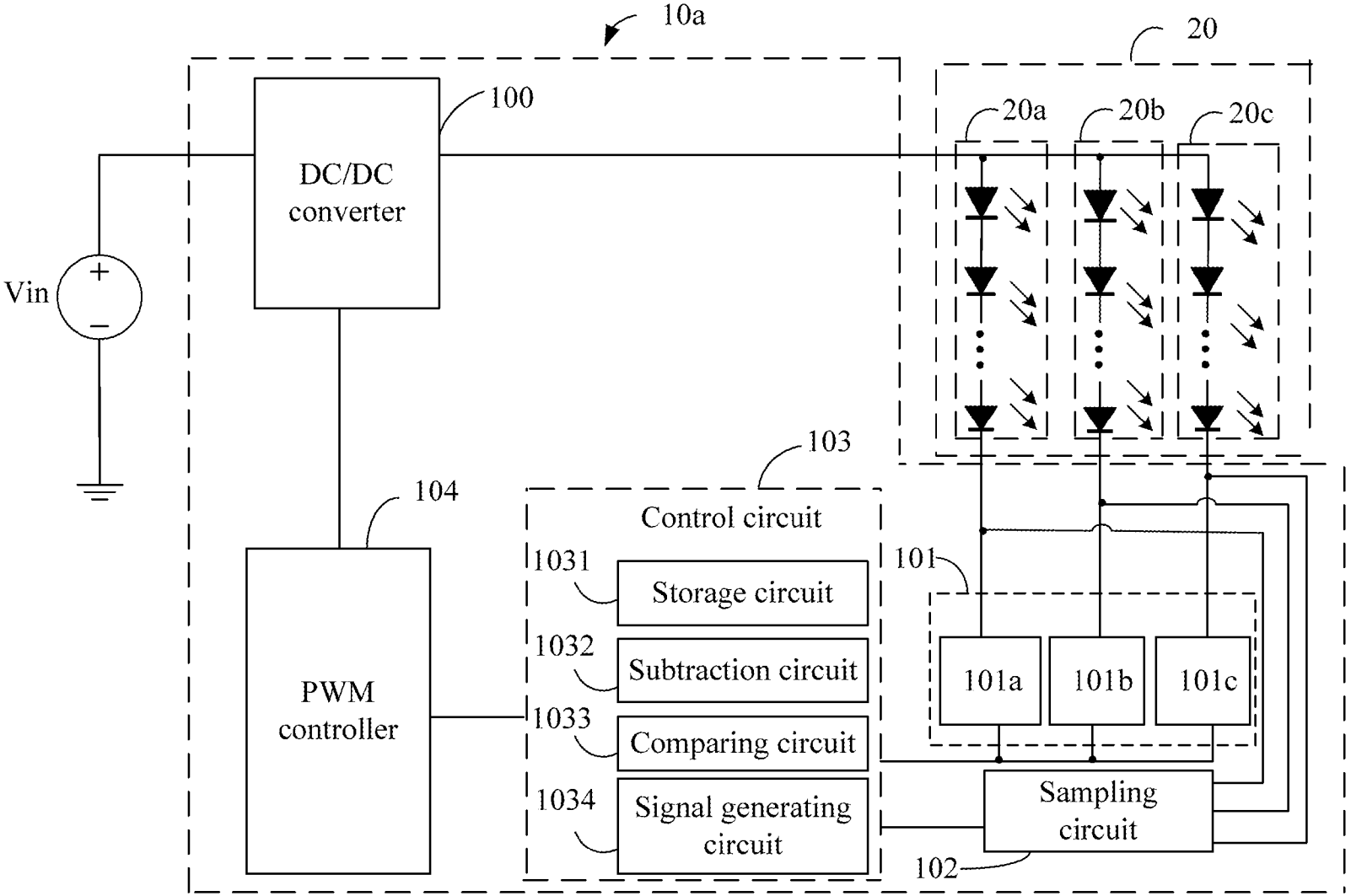
FIG. 1 is a diagram of one embodiment of a light emitting diode driving system as disclosed.

FIG. 1 is a schematic diagram of one embodiment of a light emitting diode (LED) driving system 10*a*. In one embodiment, the LED driving system 10*a* comprises a direct current/direct current (DC/DC) converter 100, a current balance circuit 101, a sampling circuit 102, a control circuit 103, and a pulse width modulation (PWM) controller 104. The LED driving system 10*a* is provided to drive an LED array 20. In one embodiment, the LED array 20 comprises a plurality of LED strings 20*a*, 20*b*, 20*c* connected in parallel, and each of the LED strings 20*a*, 20*b*, 20*c* comprises a plurality of LEDs connected in series.

In one embodiment, an anode of each of the LED strings 20*a*, 20*b*, 20*c* is an anode of the first LED of each of the LED strings 20*a*, 20*b*, 20*c*, and a cathode of each of the LED strings 20*a*, 20*b*, 20*c* is a cathode of the last LED of each of the LED strings 20*a*, 20*b*, 20*c*. Accordingly, an anode of the LED array 20 is a common node of the anodes of the LED strings 20*a*, 20*b*, 20*c*. The DC/DC converter 100 is connected to an external power supply Vin, the PWM controller 104 and the LED array 20, to convert power supplied by the external power supply Vin into suitable direct current voltage according to PWM signals generated by the PWM controller 104, and to thereby drive the LED array 20.

In one embodiment, the current balance circuit 101 is connected to cathodes of the LED strings 20*a*, 20*b*, 20*c* of the LED array 20, and balances current flowing through the LED strings 20*a*, 20*b*, 20*c*. In one embodiment, the current balance circuit 101 comprises a plurality of switches 101*a*, 101*b*, 101*c* respectively connected to the cathodes of the LED strings 20*a*, 20*b*, 20*c*. That is, the number of switches 101*a*, 101*b*, 101*c* is the same as the number of LED strings 20*a*, 20*b*, 20*c*. In other examples, the number of LED strings may be two, four or more, and correspondingly the number of switches is two, four or more. In one embodiment, the switches 20*a*, 20*b*, 20*c* are bipolar junction transistors or field effect transistors.

The sampling circuit 102 is connected to the cathodes of the LED strings 20*a*, 20*b*, 20*c*. The sampling circuit 102 detects the cathode voltages of the LED strings 20*a*, 20*b*, 20*c*, and provides feedback concerning the cathode voltages of the LED strings 20*a*, 20*b*, 20*c* to the control circuit 103. In one embodiment, the sampling circuit 102 continuously detects the cathode voltages of the LED strings 20*a*, 20*b*, 20*c*.

The control circuit 103 is connected to the sampling circuit 102, the PWM controller 104 and the current balance circuit 101. The control circuit 103 is provided to generate and output a control signal to the PWM controller 104, according to the determined cathode voltages of the LED strings 20*a*, 20*b*, 20*c*, and to thereby control a duty cycle of the PWM signals. The control circuit 103 also generates a plurality of signals to control the switches 101*a*, 101*b*, 101*c* of the current balance circuit 101 according to the duty cycle of the PWM signals. Thereby, the control circuit 103 adjusts current flowing to the LED strings 20*a*, 20*b*, 20*c*. In one embodiment, the control circuit 103 comprises a storage circuit 1031, a subtraction circuit 1032, a comparing circuit 1033, and a signal generating circuit 1034. The storage circuit 1031 stores an expectation value of the cathode voltages of the LED strings 20*a*, 20*b*, 20*c*, and a threshold value (hereinafter, "threshold"). In one embodiment, the expectation value is defined as a reference voltage that is known to make the LED strings 20*a*, 20*b*, 20*c* run steadily, and can be established by users according to experiment or empirical data. The expectation value is a same value for all three LED strings 20*a*, 20*b*, 20*c*. For example, the expectation value may be 1.2 volts (V). The threshold is the maximum voltage difference between the switches 101*a*, 101*b*, 101*c* that can be supported, such as 3.5V.

In one embodiment, the comparing circuit 1033 compares the cathode voltages of the three LED strings 20*a*, 20*b*, 20*c*, to retrieve a maximum cathode voltage among the LED strings 20*a*, 20*b*, 20*c* and a minimum cathode voltage among the LED strings 20*a*, 20*b*, 20*c*. The subtraction circuit 1032 subtracts the minimum cathode voltage from the maximum cathode voltage to obtain a difference between the maximum and the minimum cathode voltages of the set of LED strings 20*a*, 20*b*, 20*c*. The subtraction circuit 1032 also subtracts the expectation value from the minimum cathode voltage to obtain a difference between the minimum and the expectation values of the cathode voltages of the set of LED strings 20*a*, 20*b*, 20*c*. The comparing circuit 1033 determines whether the difference between the maximum and the minimum cathode voltages of the set of LED strings 20*a*, 20*b*, 20*c* is greater than the threshold; and determines whether the difference between the minimum and the expectation values of the cathode voltages of the set of LED strings 20*a*, 20*b*, 20*c* is equal to zero, and if not, whether such difference is greater than zero.

When the difference between the minimum and the expectation values of the cathode voltages of the set of LED strings 20*a*, 20*b*, 20*c* is not equal to zero, the signal generating circuit 1034 outputs a control signal according to the value of the difference, to adjust the output of the DC/DC converter 100. When the difference between the maximum and the minimum cathode voltages of the LED strings 20*a*, 20*b*, 20*c* is greater than the threshold, the signal generating circuit 1034 outputs adjusting signals to control the switches 101*a*, 101*b*, 101*c*.

As described above, in one embodiment, the comparing circuit 1033 compares the cathode voltages of the LED strings 20*a*, 20*b*, 20*c* to retrieve the maximum and the minimum cathode voltages of the set of LED strings 20*a*, 20*b*, 20*c*, and determines whether the minimum cathode voltage is equal to the expectation value of the cathode voltage. The purpose is to determine whether the LED driving system 10 is stable. If the minimum cathode voltage is not equal to the expectation value, the LED driving system 10 is deemed unstable, and the output of the DC/DC converter 100 needs to be adjusted (see below).

As described above, in one embodiment, the subtraction circuit 1032 subtracts the minimum cathode voltage from the maximum cathode voltage to calculate the difference between the maximum and the minimum cathode voltages of the set of LED strings 20*a*, 20*b*, 20*c*; and also calculates the value of the difference between the minimum and the expectation values of the cathode voltages of the set of LED strings 20*a*, 20*b*, 20*c*, if the minimum cathode voltage of the LED strings 20*a*, 20*b*, 20*c* is not equal to the expectation value. The comparing circuit 1033 determines whether the difference between the maximum and the minimum cathode voltages of the LED strings 20*a*, 20*b*, 20*c* is greater than the threshold. The signal generating circuit 1034 generates a control signal according to the value of the difference between the minimum and the expectation values of the cathode voltages, and outputs the control signal to the PWM controller 104.

In one embodiment, when the minimum cathode voltage is equal to the expectation value of the cathode voltage, the signal generating circuit 1034 generates a control signal with the original duty cycle to control the PWM controller 104 to generate the PWM signals with the original duty cycle. The PWM signals control the DC/DC converter 100 to generate a constant output of direct current voltage and thereby maintain unchanging levels of electrical current and luminance (hereinafter referred to together as "current and light") of the LED array 20.

In one embodiment, when the value of the difference between the minimum and the expectation values of the cathode voltages is greater than zero, the signal generating circuit 1034 generates a control signal with a first duty cycle to control the PWM controller 104 to generate and output the PWM signals with a first duty cycle. The PWM signals control the DC/DC converter 100 to generate a first direct current voltage to decrease the current and light of the LED array 20.

In one embodiment, when the value of the difference between the minimum and the expectation values of the cathode voltages is less than zero, the signal generating circuit 1034 generates a control signal with a second duty cycle to control the PWM controller 104 to generate and output the PWM signals with a second duty cycle. The PWM signals control the DC/DC converter 100 to generate a second direct current voltage, to increase the current and light of the LED array 20. In one embodiment, the first duty cycle is less than the second duty cycle, thus the first direct current voltage is less than the second direct current voltage.

In one embodiment, when the difference between the maximum and the minimum of the cathode voltages is greater than the threshold, the signal generating circuit 1034 generates a first adjusting signal and outputs the first adjusting signal to the switch 101*a*, 101*b* or 101*c* (hereinafter, "first target switch") that is connected to one of the LED strings 20*a*, 20*b* or 20*c* (hereinafter, "first target LED string") whose cathode voltage equals the minimum cathode voltage. The first adjusting signal decreases the conduction cycle of the first target switch 101*a*, 101*b* or 101*c* and thus decreases the current and light of the first target LED string 20*a*, 20*b* or 20*c*. Simultaneously, the signal generating circuit 1034 also generates a second adjusting signal and outputs the second adjusting signal to the switch 101*a*, 101*b* or 101*c* (hereinafter, "second target switch") that is connected to one of the LED strings 20*a*, 20*b* or 20*c* (hereinafter, "second target LED string") whose cathode voltage equals the maximum cathode voltage. The second adjusting signal increases the conduction cycle of the second target switch 101*a*, 101*b* or 101*c* and thus increases the current and light of the second target LED string 20*a*, 20*b* or 20*c*.

As described above, in one embodiment, the signal generating circuit 1034 synchronously generates a first adjusting signal and a second adjusting signal when the difference between the maximum and the minimum cathode voltages is greater than the threshold. In another embodiment, the signal generating circuit 1034 generates a first adjusting signal only or a second adjusting signal only when the difference between the maximum and the minimum cathode voltages is greater than the threshold.

In one embodiment, all of the control signals, the PWM signals, the first adjusting signals and the second adjusting signals are square-wave signals.

The first target LED string 20*a*, 20*b* or 20*c* that has the minimum cathode voltage means that the first target LED string 20*a*, 20*b* or 20*c* has a maximum voltage drop. Therefore the first adjusting signal decreases the current and light of the first target LED string 20*a*, 20*b* or 20*c*, which avoids having to adjust the duty cycle of the PWM signals according to the first target LED string 20*a*, 20*b* or 20*c* with the maximum voltage drop, and reduces the direct current voltage output by the DC/DC converter 100. This in turn reduces a voltage drop of the switches 101*a*, 101*b*, 101*c* of the current balance circuit 101, to reduce any thermal stress problems that may be caused by the switches 101*a*, 101*b*, 101*c*, and to reduce any excess of power. Moreover, the second target LED string 20*a*, 20*b* or 20*c* that has the maximum cathode voltage means that the second target LED string 20*a*, 20*b* or 20*c* has a minimum voltage drop. Therefore the second adjusting signal increases the current and light of the second target LED string 20*a*, 20*b* or 20*c*. This in turn decreases a voltage drop of the second target switch 101*a*, 101*b*, or 101*c*, to reduce any thermal stress problems that may be caused by the second target switch 101*a*, 101*b*, or 101*c*, and to reduce wastage of power.

Figure 2:
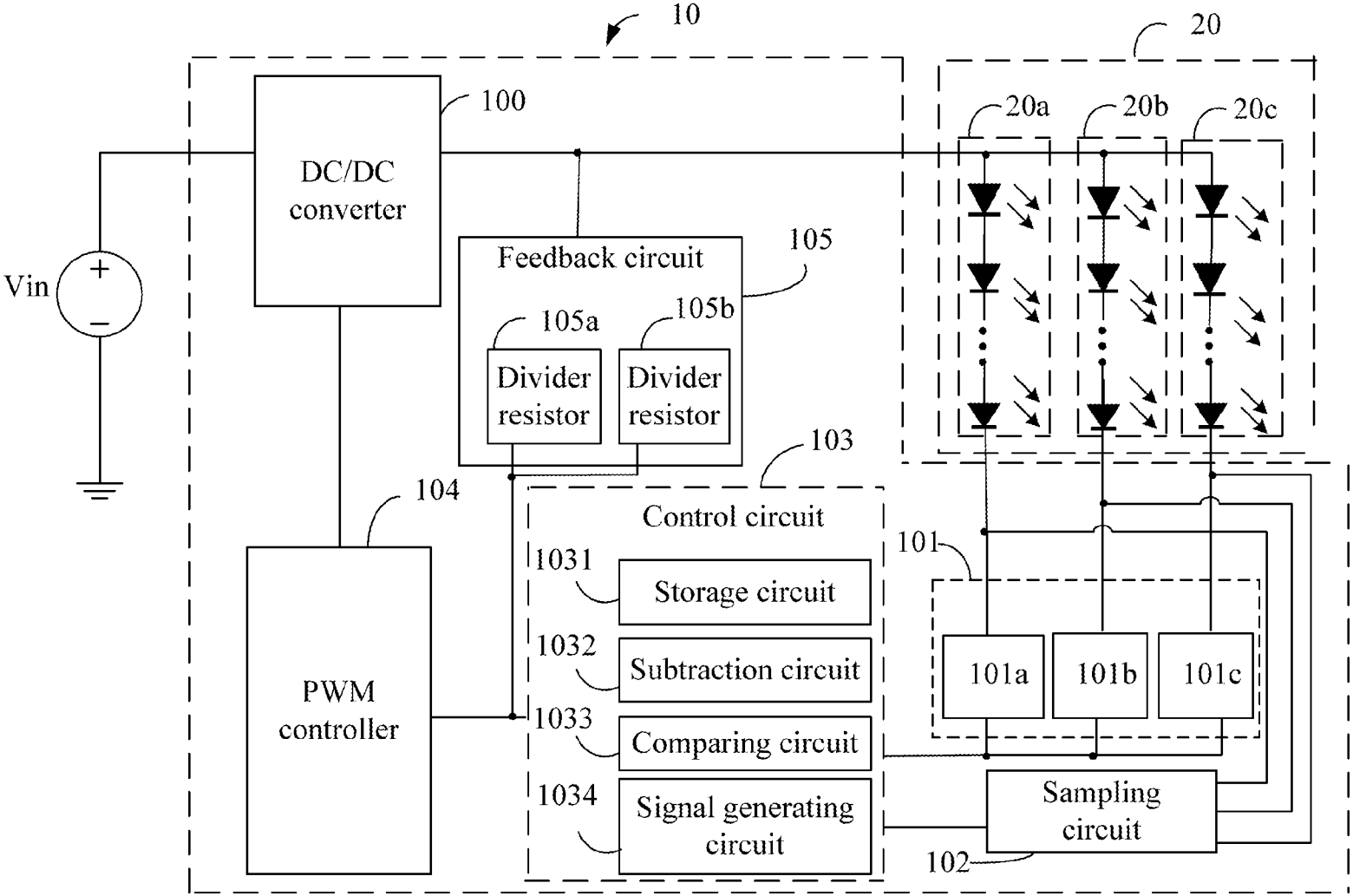
FIG. 2 is a diagram of another embodiment of a light emitting diode driving system as disclosed.

FIG. 2 is a schematic diagram of another embodiment of an LED driving system 10. The difference between the LED driving system 10 and the LED driving system 10*a* is that the LED driving system 10 further comprises a feedback circuit 105.

In one embodiment, the feedback circuit 105 is connected to an output of the DC/DC converter 100 and to the PWM controller 104. The feedback circuit 105 receives the direct current voltage output by the DC/DC converter 100, and feeds back a signal to the PWM controller 104, to adjust the duty cycle of the PWM signals. In one embodiment, the feedback signal and the control signal (see above) adjust the duty cycle of the PWM signals together, and thereby adjust the level of direct current voltage output by the DC/DC converter 100. In one embodiment, the feedback signals play a major role, and the control signals play a secondary role, in adjusting the duty cycles of the PWM signals.

In one embodiment, the feedback circuit 105 comprises two divider resistors 104*a*, 104*b* connected between the output of the DC/DC converter 100 and ground. The two resistors 105*a*, 105*b* are connected in series, and cooperatively act as a voltage divider. The PWM control circuit 102 is connected to a node between the two resistors 105*a*, 105*b*. In an alternative embodiment, the feedback circuit 105 comprises a coil, to output a feedback signal to the PWM controller 104 according to the direct current voltage output by the DC/DC converter 100, and thereby adjust the duty cycle of the PWM signals.

Figure 3:
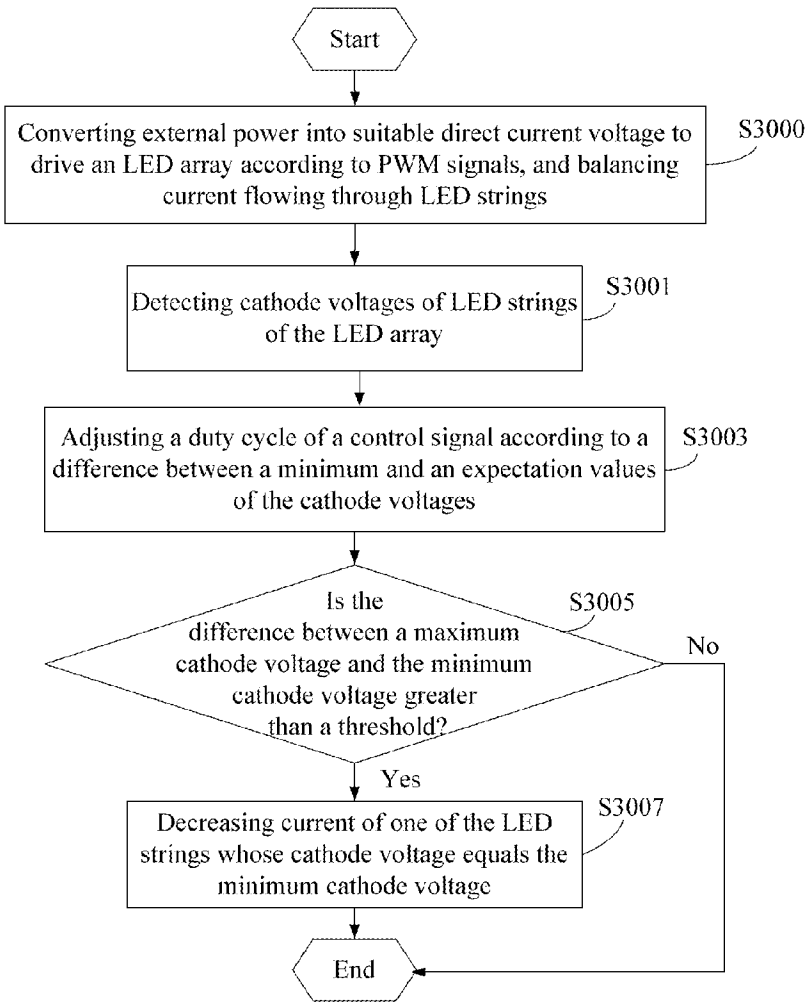
FIG. 3 is a flowchart of one embodiment of a light emitting diode driving method as disclosed.

FIG. 3 is a flowchart of one embodiment of an LED driving method. Firstly, in block S3000, the DC/DC converter 100 converts external power supplied by the power supply Vin into a direct current voltage, suitable for driving the LED array 20 according to the PWM signals, and balances the current flowing through the LED strings 20*a*, 20*b*, 20*c*. In block S3001, the sampling circuit 102 detects the cathode voltages of the LED strings 20*a*, 20*b*, 20*c*, and feeds back the cathode voltages of the LED strings 20*a*, 20*b*, 20*c* to the control circuit 103.

Subsequently, in one embodiment of the LED driving method, block S3003 is processed first, and then blocks S3005 and S3007 are processed later. In another embodiment of the LED driving method, blocks S3005 and S3007 are processed first, and then block S3003 is processed later.

In block S3003, the control circuit 103 generates control signals according to any difference between the minimum and the expectation values of the cathode voltages of the set of LED strings 20*a*, 20*b*, 20*c*, to adjust the duty cycle of the PWM signals, and thereby to adjust the level of direct current voltage output by the DC/DC converter 100. In block S3005, the control circuit 103 determines whether any difference between the maximum and the minimum cathode voltages of the set of LED strings 20*a*, 20*b*, 20*c* is greater than the threshold.

In the embodiment, if a difference between the maximum and the minimum cathode voltages is greater than the threshold, in block S3007, to avoid the voltage drop of the switches 101*a*, 101*b*, 101*c* causing thermal stress, the control circuit 103 generates a first adjusting signal and outputs the first adjusting signal to the current balance circuit 101. The first adjusting signal decreases the current and light of the first target LED string 20*a*, 20*b* or 20*c* having the minimum cathode voltage, which avoids the need to adjust the duty cycle of the PWM signals according to the first target LED string 20*a*, 20*b* or 20*c* with the maximum voltage drop, and reduces a voltage drop of the switches 101*a*, 101*b*, 101*c* of the current balance circuit 101. This in turn reduces any thermal stress that may be caused by the switches 101*a*, 101*b*, 101*c*, and reduces wastage of power.

Figure 4:
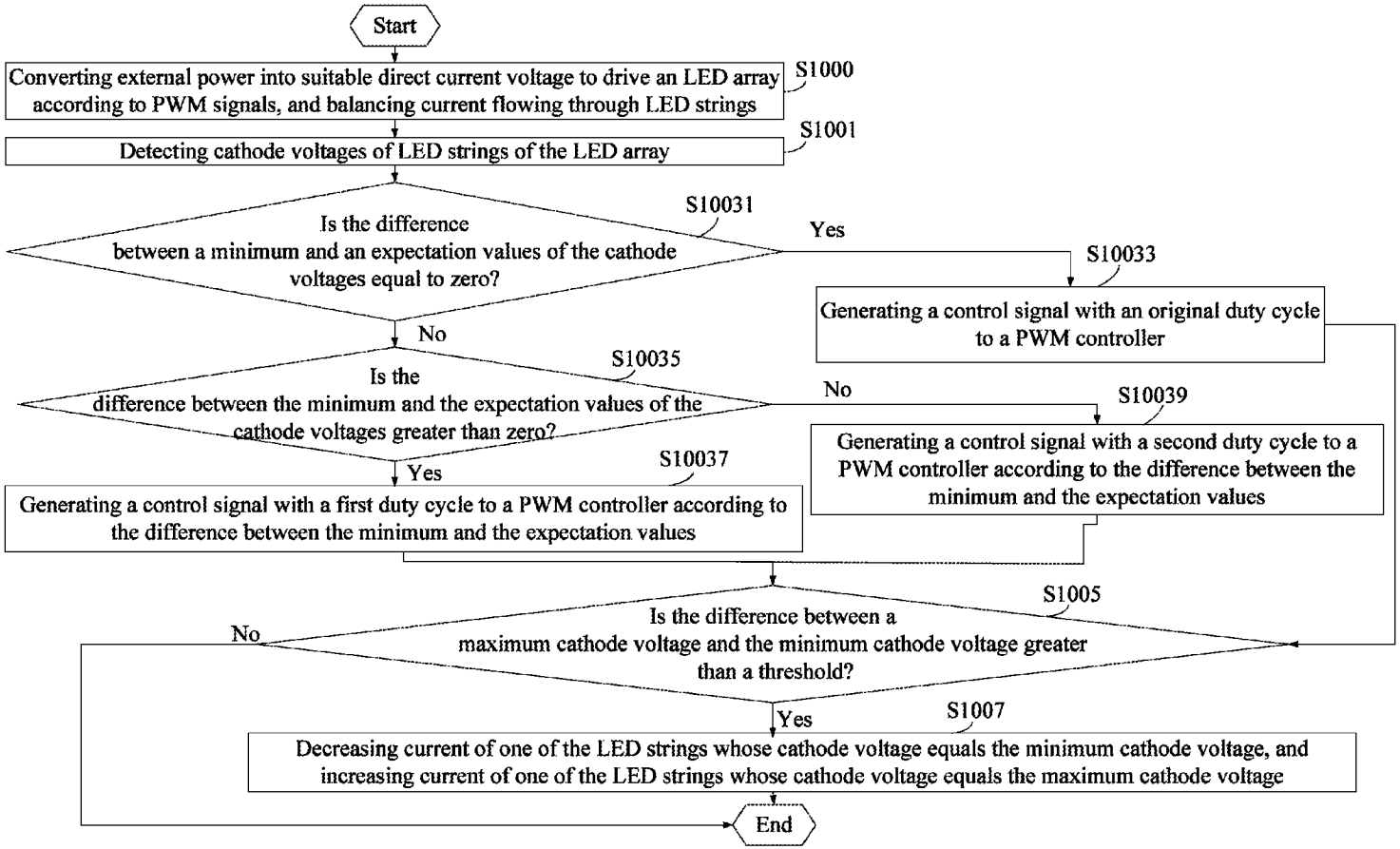
FIG. 4 is a flowchart of another embodiment of a light emitting diode driving method as disclosed.

FIG. 4 is a flowchart of another embodiment of an LED driving method (hereinafter, "second LED driving method"). In one embodiment of the second LED driving method, blocks S1000, S1001, S1005 and S1007 are substantially the same as or correspond to blocks S3000, S3001, S3005 and S3007 of the LED driving method of FIG. 3, respectively.

In particular, in one embodiment of the second LED driving method, block S1007 further comprises the current balance circuit 101 increasing the current of the second target LED string 20*a*, 20*b* or 20*c* that has a cathode voltage equaling the maximum cathode voltage of the set of LED strings 20*a*, 20*b*, 20*c*. Details of the process of the current balance circuit 101 increasing the current of the second target LED string 20*a*, 20*b* or 20*c* are provided above, and are not repeated here for the sake of brevity.

In one embodiment of block S10031 of the second LED driving method, the control circuit 103 determines whether a difference between the minimum and the expectation values of the cathode voltages of the set of LED strings 20*a*, 20*b*, 20*c* is equal to zero. If there is no difference between the minimum and the expectation value of the cathode voltages, that is, they are the same, then in block S10033, the control circuit 103 generates a control signal with the original duty cycle, to control the PWM controller 104 to generate the PWM signals with the original duty cycle. The PWM signals control the DC/DC converter 100 to generate a constant output, to maintain the present levels of current and light of the LED array 20. If the minimum cathode voltage is not equal to the expectation value of the cathode voltage, then the method proceeds to block S10035.

In one embodiment, in block S10035, the control circuit 103 determines whether a value of the difference between the minimum cathode voltage and the expectation value of the cathode voltage is greater than zero. If the value of the difference between the minimum cathode voltage and the expectation value of the cathode voltage is greater than zero, in block S10037, the control circuit 103 generates a control signal with a first duty cycle to control the PWM controller 104 to generate and output PWM signals with a first duty cycle. The PWM signals control the DC/DC converter 100 to generate a first direct current voltage to decrease the current and light of the LED array 20. If the value of the difference between the minimum cathode voltage and the expectation value of the cathode voltage is smaller than zero, then the method proceeds to block S10039.

In one embodiment, in block S10039, the control circuit 103 generates a control signal with a second duty cycle, to control the PWM controller 104 to generate the PWM signals with a second duty cycle. Thus the DC/DC converter 100 generates a second direct current voltage, to increase the current and light of the LED array 20. In one embodiment, the first duty cycle is less than the second duty cycle, thus the first direct current voltage is less than the second direct current voltage.

The LED driving system 10 and the second LED driving method can adjust the current of the first target LED string 20*a*, 20*b* or 20*c* that has a cathode voltage equaling the minimum cathode voltage, and also adjust the current of the second target LED string 20*a*, 20*b* or 20*c* that has a cathode voltage equaling the maximum cathode voltage, as long as the difference between the maximum and the minimum cathode voltages is greater than the threshold. Moreover, the LED driving system 10 and the second LED driving method adjust the duty cycle of the control signal according to the minimum cathode voltage of the set of LED strings 20*a*, 20*b*, 20*c*, thereby controlling the duty cycle of the PWM signals outputted by the PWM controller 102, and thereby controlling the direct current voltage output to the LED array 20. This reduces any thermal stress associated with the power loss (wastage) of the switches 101*a*, 101*b*, 101*c*.

The foregoing disclosure of the various embodiments has been presented for purposes of illustration and description. It is not intended to be exhaustive or to limit the invention to the precise forms disclosed. Many variations and modifications of the embodiments described herein will be apparent to one of ordinary skill in the art in the light of the above disclosure.

The scope of the invention is to be defined only by the claims appended hereto and their equivalents.

What is claimed is:

1. A light emitting diode (LED) driving method for driving an LED array comprising a plurality of LED strings connected in parallel, each LED string having an anode and a cathode, the LED driving method comprising:

converting an external power supplied by an external power supply into a direct current voltage to drive the LED array according to pulse width modulation (PWM) signals outputted by a PWM controller, and using a current balance circuit to balance current flowing through the LED strings;

detecting a cathode voltage of each LED string, wherein the cathode voltages detected comprise a minimum cathode voltage among the LED strings and a maximum cathode voltage among the LED strings;

defining an expectation value of the cathode voltage of each LED string;

adjusting a duty cycle of a controlling signal outputted to the PWM controller according to a difference between the minimum cathode voltage and the expectation value of the cathode voltage; and in response to a difference between the maximum cathode voltage and the minimum cathode voltage being greater than a predetermined threshold, decreasing a current of one of the LED strings whose cathode voltage equals the minimum cathode voltage.

2. The LED driving method of claim 1, further comprising:

in response to the difference between the maximum cathode voltage and the minimum cathode voltage being greater than the threshold, increasing a current of one of the LED strings whose cathode voltage equals the maximum cathode voltage.

3. The LED driving method of claim 1, wherein adjusting the duty cycle of the controlling signal outputted to the PWM controller according to the difference between the minimum cathode voltage and the expectation value of the cathode voltage comprises:

in response to the minimum cathode voltage being greater than the expectation value of the cathode voltage, decreasing the duty cycle and outputting the controlling signal with the decreased duty cycle to the PWM controller to decrease the direct current voltage; or in response to the minimum cathode voltage being smaller than the expectation value of the cathode voltage, increasing the duty cycle and outputting the controlling signal with the increased duty cycle to the PWM controller to increase the direct current voltage.

4. The LED driving method of claim 1, further comprising:

in response to the minimum cathode voltage equaling the expectation value of the cathode voltage, outputting the controlling signal with the original duty cycle to the PWM controller.

5. The LED driving method of claim 1, further comprising:

comparing the cathode voltages of the LED strings to obtain the maximum cathode voltage and the minimum cathode voltage among the LED strings; and calculating a difference between the maximum cathode voltage and the minimum cathode voltage.

6. A light emitting diode (LED) driving system, driving an LED array comprising a plurality of LED strings connected to each other in parallel, each LED string having an anode and a cathode, the LED driving system comprising:

a direct current/direct current (DC/DC) converter that converts an external power supplied by an external power supply into a direct current voltage to drive the LED array;

a sampling circuit connected to a cathode of the LED array, the sampling circuit detecting a cathode voltage of the respective cathode of each LED string, the cathode voltages detected comprising a minimum cathode voltage among the LED strings and a maximum cathode voltage among the LED strings;

a control circuit connected to the sampling circuit, the control circuit storing a predetermined expectation value of the cathode voltage of each LED string and storing a predetermined threshold, and comprising:

a comparing circuit, comparing the detected cathode voltages of the LED strings;

a subtraction circuit, calculating a difference between the maximum cathode voltage and the minimum cathode voltage, and calculating a difference between the minimum cathode voltage and the expectation value of the cathode voltage, wherein the comparing circuit determines whether any difference between the maximum cathode voltage and the minimum cathode voltage is greater than the threshold; and a signal generating circuit, generating and outputting a control signal according to the difference between the minimum cathode voltage and the expectation value of the cathode voltage, and generating a first adjusting signal when the difference between the maximum cathode voltage and the minimum cathode voltage is greater than the threshold, the first adjusting signal increasing a current of one of the LED strings whose cathode voltage equals the minimum cathode voltage;

a pulse width modulation (PWM) controller, connected to the control circuit, and generating and outputting PWM signals according to the control signal; and a current balance circuit, connected to the cathodes of the LED strings and connected to the signal generating circuit, the current balance circuit comprising a plurality of switches, balancing current flowing through the LED strings, and decreasing a current of one of the LED strings whose cathode voltage equals the minimum cathode voltage according to the first adjusting signal.

7. The LED driving system of claim 6, wherein the comparing circuit further determines whether the minimum cathode voltage is greater than the expectation value of the cathode voltage.

8. The LED driving system of claim 7, wherein in response to the minimum cathode voltage being greater than the expectation value of the cathode voltage, the signal generating circuit outputs the control signal with a first duty cycle; in response to the minimum cathode voltage being smaller than the expectation value of the cathode voltage, the signal generating circuit outputs the control signal with a second duty cycle different from the first duty cycle; and in response to the minimum cathode voltage being equal to the expectation value of the cathode voltage, the signal generating circuit outputs the control signal with the original duty cycle.

9. The LED driving system of claim 6, wherein the signal generating circuit further generates a second adjusting signal when the difference between the maximum cathode voltage and the minimum cathode voltage is greater than the threshold, the second adjusting signal increasing a current of one of the LED strings whose cathode voltage equals the maximum cathode voltage.

10. The LED driving system of claim 6, further comprising:

a feedback circuit connected to an output of the DC/DC converter, and generating and outputting a feedback signal to the PWM controller to adjust a duty cycle of the PWM signals according to the direct current voltage.

11. The LED driving system of claim 6, wherein the control circuit further comprises a storage circuit, which stores the expectation value and the threshold.

* * * * *